United States Patent [19]

Bergman

[11] Patent Number: 4,622,837

[45] Date of Patent: Nov. 18, 1986

[54] TUBE BENDER WITH SPIRIT LEVEL INDICATOR

[75] Inventor: Brian A. Bergman, Milwaukee, Wis.

[73] Assignee: Gardner Bender, Inc., Milwaukee, Wis.

[21] Appl. No.: 797,515

[22] Filed: Nov. 13, 1985

[51] Int. Cl.[4] ..... B21C 51/00

[52] U.S. Cl. ..... 72/34; 72/459; 33/334; 33/370

[58] Field of Search ..... 72/31, 33, 32, 34, 35, 72/459; 33/334, 370, 371, 372, 373, 379

[56] References Cited

U.S. PATENT DOCUMENTS

| | | | |
|---|---|---|---|
| 2,932,225 | 4/1960 | Gardner | 72/459 |
| 3,906,778 | 9/1975 | Crouse | 72/459 |
| 4,009,602 | 3/1977 | Linquist | 72/459 |
| 4,052,881 | 10/1977 | Mount | 72/34 |
| 4,063,444 | 12/1977 | Vecho | 72/32 |
| 4,425,784 | 1/1984 | D'Gerolamo | 72/36 |
| 4,442,695 | 4/1984 | Gardner | 72/459 |
| 4,452,064 | 6/1984 | Custin | 72/459 |

*Primary Examiner*—Leon Gilden

*Attorney, Agent, or Firm*—James E. Nilles

[57] ABSTRACT

The conduit bending tool of this invention has on its body a pair of pads which are spaced apart in the direction lengthwise of the arcuate bending shoe and which define recesses that open to one side of the body wherein end portions of a straight cylindrical spirit level vial are closely receivable. Cement on a surface of each recess that embraces the vial partway around it secures the vial in place. The pads and recesses are defined by one of the two main mold elements that form the body, which have their parting place on a plane of symmetry in the body, and the vial is installed by simply inserting it into the recesses.

5 Claims, 8 Drawing Figures

TUBE BENDER WITH SPIRIT LEVEL INDICATOR

FIELD OF THE INVENTION

This invention relates to tools for manually bending electrical conduit and similar pipes and tubes, having means for indicating when a tube or the like that is being bent by the tool has been brought to a predetermined bend angle; and the invention is more particularly concerned with improvements in a portable conduit bending tool having bend angle indicating means that comprises a spirit level mounted on the body of the tool in such an orientation that its bubble is centered when a predetermined bend angle is attained.

BACKGROUND OF THE PRIOR ART

Tools for bending tubes, pipes and electrical conduits are of a well-known type, usually comprising a one-piece body that has an elongated, downwardly grooved arcuate shoe at its bottom, a hook at its front, and an upwardly projecting handle socket in which a shaft-like handle is removably receivable. The hook is engaged under a length of tubing to be bent, which is held down against a floor or other supporting surface, and bending force exerted upon the handle, transmitted to the tube by means of the hook, curves the tube around the shoe.

Various expedients have been devised for indicating to the person using such a tool, during a bending operation, that a predetermined angle of bend has been obtained. As examples of these, reference can be made to U.S. Pat. Nos. 2,953,048, 2,666,351, 3,718,018, 4,052,881, 4,009,602 and 4,442,695.

One of the relatively few types of bend angle indicators that has enjoyed significant commercial success is disclosed in U.S. Pat. No. 2,932,225. It comprises a spirit level vial mounted on the body of the bending tool in a position to be readily visible to the person using the tool and in a lengthwise orientation such that its indicating bubble is centered when a predetermined bend angle is attained. In most of the popular tube benders that incorporate such spirit level indicators, two of them are mounted on the tube body, oriented to signal, respectively, the attainment of bend angles of 45° and 90°, these being the bend angles most frequently needed.

Bending tools with spirit level bend indicators have been produced and sold in substantially high volume for more than a quarter of a century. During all of that long period of time the installation of the spirit level vial or vials to the bender body has been a laborious and time consuming procedure. In the commercial form of such tools, the spirit level vial has been installed somewhat differently than as disclosed in U.S. Pat. No. 2,932,225, in an arrangement whereby the vial was protected by the metal body of the tool while still being visible to the user of the tool during a bending operation. The body of the bender was made as a one-piece casting, usually of aluminum alloy, formed with an elongated pad for each spirit level vial. Each pad had at its top a lengthwise extending arcuate bay or concavity that served as a window through which the vial could be seen after it was installed in the pad. For installing the vial, a hole was drilled lengthwise into the pad from one end of it, communicating with the bay and continuing beyond it. The vial was inserted lengthwise into this hole to have its end portions confined in the pad while the major portion of its length was exposed in the window defined by the junction of the bay with the drilled hole.

Since the spirit level vial that was conventionally used was arcuately curved along its length, the hole that was drilled in the pad had to be oversize, that is, its diameter had to be larger than that of the vial. The vial therefore had a very loose fit in the hole and had to be adjusted and fixed at a correct orientation before it could be sealed into the pad. To this end the tool body was secured in a fixture that held it in an attitude corresponding to the bend angle designated by the spirit level, and a toothpick was pushed into the hole in the pad, wedged between the metal and the vial, and shifted as necessary to center the bubble in the vial. The outer end of the hole was then filled with a viscous or plaster-like cement material to fix the position of the vial in cooperation with a dab of that material which had been placed into the blind end of the hole before the vial was inserted. After the cement had partially hardened the toothpick was withdrawn. As a final step, the hardened plug of cement was painted to match the metal body.

The labor required for such installation required a substantial amount of time and was therefore expensive. As a result, tube benders with spirit level angle indicators sold at a substantially higher price than those without such indicators, but there has nevertheless been a substantial and consistent demand for them, such that many thousands are made and sold every year. In view of this volume, it was obvious that any substantial reduction in the time and effort needed for installing spirit level vials would reduce costs and thus yield increased profits for the manufacturer. What was clearly not obvious was how to achieve this benefit. Certainly the long standing failure to do so was not for lack of incentive, since the manufacture of tube benders is a highly competitive industry.

In the light of the present invention it may appear that there should have been no great difficulty in devising ways or means to reduce the labor needed for installing spirit level vials on tube bender bodies, but in fact the problem of doing so was complicated by the need to satisfy other requirements. The body of a tube bender is conventionally molded in one piece, and there would be little or no advantage in expediting spirit level installation at the cost of sacrificing sturdiness of the body or its capability for being economically molded by means of apparatus comprising a minimum number of relatively movable mold or die elements. In addition, the spirit level vial or vials, being fragile, must be well protected by adjacent portions of the body but must nevertheless be readily visible from above the body. And of course the establishment and maintenance of a precise orientation of each spirit level vial is of the essence.

SUMMARY OF THE INVENTION

The general object of the present invention is to achieve a significant reduction in the cost of manufacturing an angle indicating tube bender of the type having spirit level angle indicating means without sacrificing any of the characteristics desirable in such a tool.

More specifically, it is an object of this invention to provide an angle indicating tube bender of the character described that has a one-piece body which is so formed and arranged that insertion, orientation and securement of the spirit level vial or vials can be accomplished quickly and easily without special tools or equipment.

Another specific object of the invention is to provide a one-piece tube bender body on which spirit level indicators can be quickly and easily installed and which can itself be produced at a cost no higher than that of heretofore conventional bodies for tube benders with spirit level indicators, so that the savings involved in the more rapid and facile installation of the tube bender vials are fully realized in the finished product.

Another and very important objective of the invention is to provide a tube bending tool with spirit level bend angle indicators that achieves the above stated objects and wherein the spirit level vials are well protected by adjacent portions of the metal body of the tool but are nevertheless readily visible from above the body.

In general, these and other objects of the invention that will appear as the description proceeds are achieved in a tool of this invention for bending conduit and the like, comprising a body having opposite sides and having a conduit engaging hook at a front end thereof, an elongated bottom shoe portion extending rearward from said hook that is curved in a convex arc along its length and has a downwardly projecting flange along each of its opposite sides, and an upwardly projecting handle supporting portion, said tool further comprising an elongated spirit level vial on the body for indicating the attainment of a predetermined bend angle in conduit being bent by means of the tool. The tool of this invention is characterized by its spirit level vial being cylindrical and straight along its length; and further characterized by a pair of pads on the body, one for each end portion of the vial, which cooperate to support the vial in a predetermined position with its length parallel to that of said shoe portion, each said pad projecting towards one side of the body and being shaped to define a recess which opens towards the other pad and towards said one side of the body and into which an end portion of the vial is closely receivable upon movement of the vial transversely to its length from said one side of the body, said pads being spaced apart in a direction lengthwise of said shoe portion by a distance such that a substantial length of the vial between its end portions is left open to view from above the body.

BRIEF DESCRIPTION OF THE DRAWINGS

In the accompanying drawings, which illustrate what is now regarded as a preferred embodiment of the invention.

DETAILED DESCRIPTION OF PREFERRED EMBODIMENT OF THE INVENTION

Figure 1:
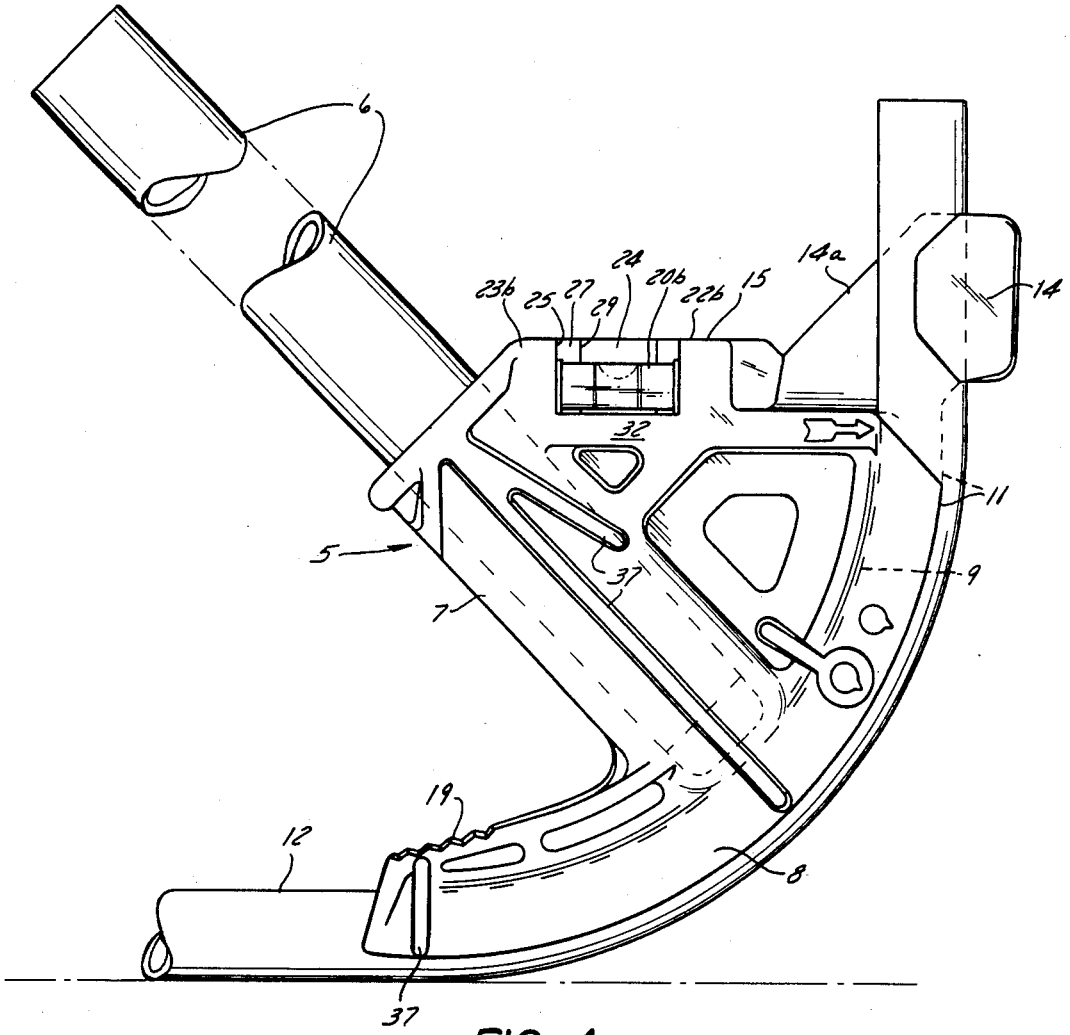
FIG. 1 is a view in side elevation of a tube bending tool that embodies the principles of this invention, shown in the attitude in which it has imparted a 90° bend angle to a tube being bent.

A tool for bending tubing, pipe, conduit and the like that embodies the principles of this invention comprises a sturdy body 5 that is formed as a one-piece casting, together with an elongated shaft-like handle 6 which can be made of rigid steel tubing and which is removably received in an upwardly projecting socket-like handle supporting portion 7 of the body. The body 5 is elongated, extending substantial distances both forwardly and rearwardly from its handle supporting portion 7.

A bottom portion of the body 5 comprises an elongated shoe 8 that is curved along its length to a convex arc. At its bottom the shoe 8 has a pair of flanges 11, one extending along each of its opposite sides, between which there is a downwardly opening conduit-receiving groove 9 that extends along the full length of the shoe. The groove 9 is concavely curved across its width on a radius substantially equal to that of tubing to be bent by means of the tool.

The shoe 8 is symmetrical from side to side relative to a plane of symmetry P that lies inside the body 5, and the handle supporting socket 7, which is substantially cylindrical, has its axis contained in that plane of symmetry. It will be apparent that the tool body 5 can therefore be formed in one piece, by either a die casting or a permanent mold process, with the use of two main mold elements that have their parting plane on the plane of symmetry P.

The front end portion of the body 5 comprises a forwardly projecting upwardly opening hook 14. To support the high stresses that are imposed during a bending operation upon the handle socket 7 and the hook 14, those two portions of the tool body are connected by a front vertical arm or web 15 that is also joined to the shoe 8. The rear portion of the shoe 8, which projects behind the handle socket 7, has its upper surface transversely ridged to define a pedal 19 upon which the user of the tool can place one foot to hold the shoe down against the tubing being bent and to produce a bending force which supplements the force applied to the handle 6.

Bending a length of conduit 12 with the tool of this invention is generally conventional in that the hook 14 is engaged under the conduit and then, with the conduit otherwise supported by the floor, and with the shoe 8 straddling the conduit, force is applied to the pedal 19 and the handle 6 in the direction to swing the handle rearward. This rocks the body 5 on the arc of the shoe 8, raising the hook 14, which cooperates with the floor to bend the conduit around the shoe.

The arcuate bend imparted to the conduit or tubing 12 as the tool body 5 is rocked has a radius substantially equal to that of the arc to which the shoe 8 is curved along its length. But the bend angle produced in the conduit is of course dependent upon the distance through which the handle 6 is swung rearward during the bending operation. The bend angle is the angle between the straight sections of conduit that are at opposite ends of the curve imparted to the conduit by means of the tool.

In a tool of the type to which the present invention relates, the attainment of a predetermined bend angle is indicated when the tool is in use by the centering of the bubble in a spirit level vial that is mounted on the tool body in a fixed orientation, essentially as in the tool of U.S. Pat. No. 2,932,225. As here illustrated, two such vials 20*a* and 20*b* are mounted on the body, one of them 20*a* being so oriented that its bubble centers when the tool body is in the attitude for a 45° bend angle, the other 20*b* being arranged to indicate the attainment of a 90° bend angle. These vials are mounted on opposite sides of the web or arm 15 that connects and reinforces the shoe 8, the hook 14 and the handle socket 7. As shown, the vial 20*a* is mounted at the left side of the web 15, looking forward along the body toward the hook 14, and the vial 20*b* is mounted at the right side of that web.

In the bending tool of the present invention each of the vials 20*a*, 20*b* is plainly cylindrical, that is, it has a uniform diameter all along its length and has no curvature along its length. The two vials 20*a*, 20*b* are preferably alike as to length and diameter.

The mounting for the vial 20*a* comprises a pair of pads 22*a* and 23*a* which project from the web or arm 15 towards the left side of the body 5 and which are spaced apart in the direction lengthwise of the shoe 8. The rear one of these pads 23*a* is in the corner defined by the junction of the handle socket 7 with the web 15 and thus reinforces that junction. The front pad 22*a* is at the junction of the web 15 with the lengthwise extending arm 19 that connects the hook 14 with the main part of the body 5, and it thus provides desirable reinforcement to that junction.

Each of the pads 22*a*, 23*a* defines a recess 24 which opens towards the left side of the body and towards the like recess defined by the other pad, and the end portions of the vial 20*a* are closely receivable in these recesses upon movement of the vial transversely to its length in the direction from the left side of the body 5 towards the plane of symmetry. More specifically, each of the pads 22*a*, 23*a* has a flat inwardly facing surface 25 which opposes and is parallel to the corresponding flat surface 25 on the other pad 23*a*, 22*a*, and these two surfaces 25 are spaced apart by a distance at least equal to the length of the vial 20*a* and define between them a space which opens unrestrictedly to the left side of the body and into which the vial 20*a* can be inserted by its movement as just described. Each pad also has a vial supporting portion 27 that projects from its said flat surface 25 partway towards the other pad. A concavely arcuate surface 28 on the vial supporting portion 27, facing generally away from the plane of symmetry, cooperates with its adjacent flat surface 25 to define the recess 24 for an end portion of the vial 20*a*. Each of the arcuate surfaces 28 is curved on a radius substantially equal to that of the vial and embraces the installed vial around no more than half of its girth and at its side adjacent to the plane of symmetry of the body.

The vial supporting portion 27 of each pad has a preferably flat inner surface 29 that faces the corresponding surface 29 on the other pad, and these portions of the pads are spaced apart by a substantial distance, to leave a major part of the length of the vial 20*a* that is between its end portions exposed to view from above the tool body. Preferably the top of each vial supporting portion 27 projects away from the plane of symmetry only to such a distance that it overlies the top of the vial across no more than half of its diameter, thus leaving the left-hand half of the vial 20*a* exposed to view along its entire length, so that during the bending of a tube the position of the bubble in the vial is readily visible as it progresses from one end of the vial to the center position identified by the conventional spaced apart hairlines 30 around the vial.

Figure 8:
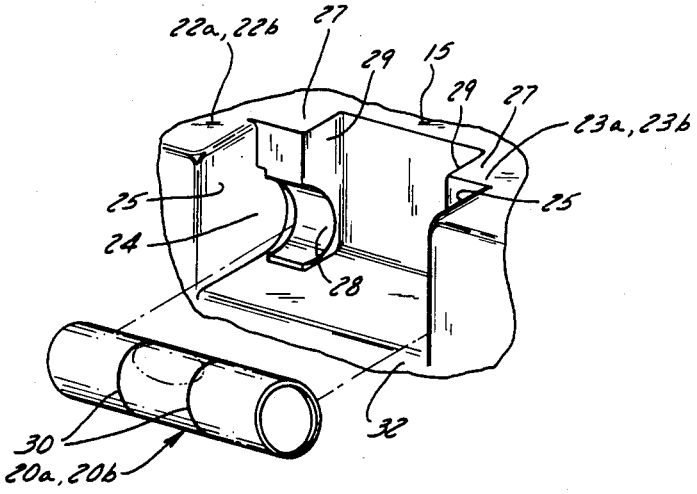
FIG. 8 is a fragmentary perspective view of a portion of the bender body that defines a vial pocket, in disassembled relationship to a vial to be received therein.
Figure 2:
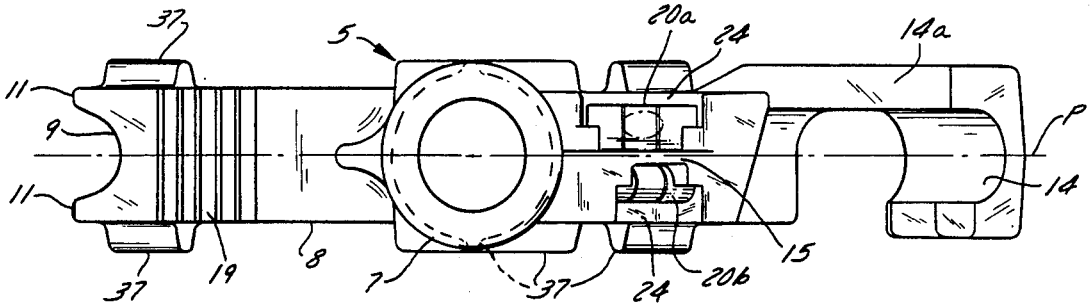
FIG. 2 is a top view of the tube bending tool, shown in its attitude for a 45° bend angle.
Figure 4:
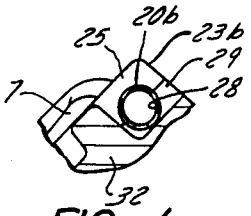
FIG. 4 is a fragmentary view in section taken on the plane of the line 4—4 in FIG. 3.
Figure 3:
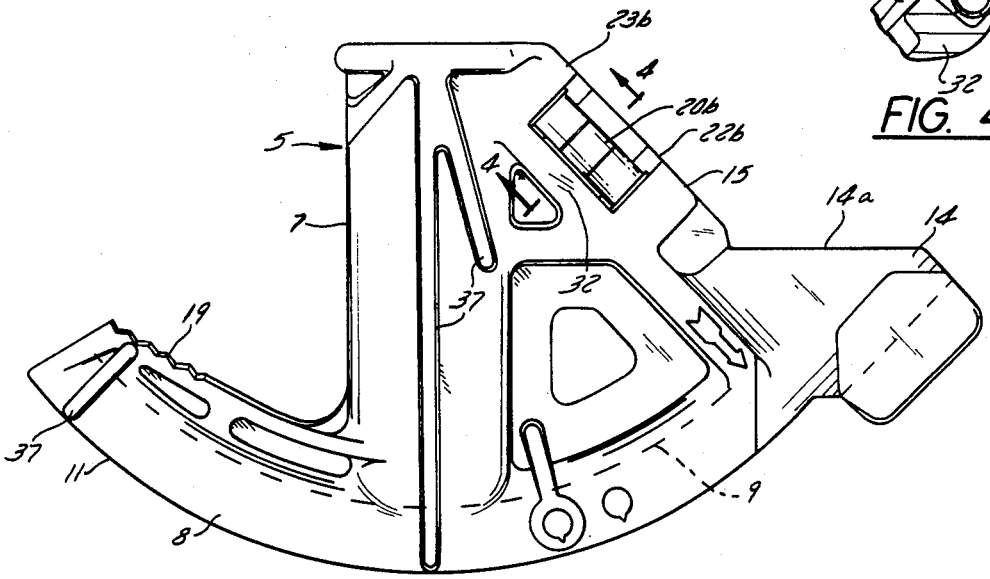
FIG. 3 is a view in elevation generally like FIG. 1 but showing the tool body in its attitude for a 45° bend angle.
Figure 6:
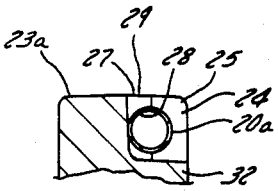
FIGS. 6 and 7 are fragmentary sectional views respectively taken on the planes of the lines 6—6 and 7—7 in FIG. 5.
Figure 7:
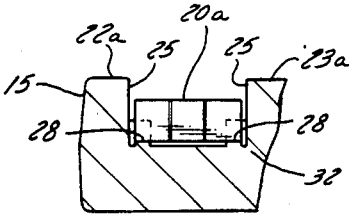
Figure 5:
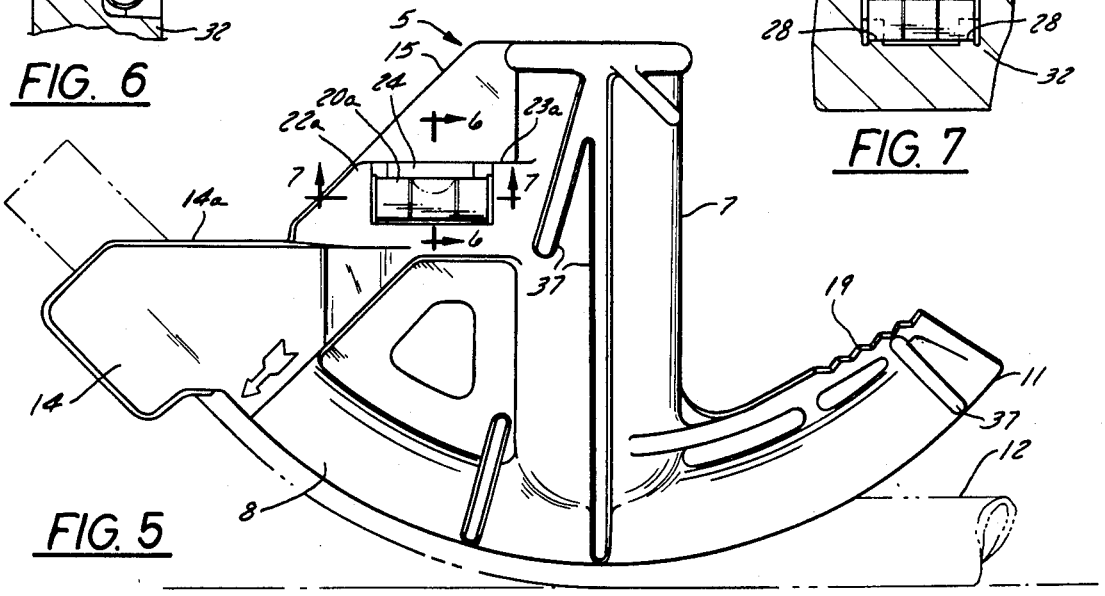
FIG. 5 is a view in elevation, showing the tool body from the side thereof opposite to the one seen in FIG. 3.

As will be especially apparent from FIG. 8, the entire space between the pads 22*a* and 23*a*, including the recesses 24 in which the end portions of the vial are received, can be defined by integral portions of a main mold element (not shown) which forms one side of the body and which is opened by relative movement in the direction away from the plane of symmetry P of the body. Thus the body, as molded, is immediately ready to receive the vial, without need for drilling or other machining. The only preparation needed for installation of the vial is to dab a small amount of cyanoacrylic cement or similar adhesive onto each of the arcuate surfaces 28 and insert the vial into the space between the pads, engaging its end portions firmly in the arcuate surfaces 28 which, by their closely embracing engagement, establish the vial in its correct position and orientation without necessity for any adjustment.

The vial 20*b* at the right hand side of the body is confined in recesses 24 which are substantially identical to those for the left hand vial 20*a* as described above, defined by a pair of pads 22*b*, 23*b* that project to the right from the reinforcing web 15. The front pad 22*b* is disposed substantially back-to-back with the other front pad 22*a* and cooperates with it in reinforcing and supporting the hook arm 14*a*. The rear pad 23*b* is at the junction of the web 15 with the upper end portion of the handle socket 7 and provides desirable reinforcement to that junction. The recesses 24 for the vial 20*b* are defined by integral portions of the main mold member (not shown) that forms the right half of the body, and, again, installation of the vial 20*b* is accomplished by merely applying dabs of cement and setting it firmly in place.

Preferably the two pads 22*a*, 23*a* and 22*b*, 23*b* at each side of the web 15 are bridged at their bottoms by a shelf-like reinforcing rib 32 which underlies the vial 20*a*, 20*b* between the pads and projects laterally some distance beyond it. Each of these ribs 32 materially stiffens the web 15, defines an upwardly facing contrast surface under its vial that increases the visibility of its bubble, and serves to protect the vial by projecting a substantial distance laterally beyond it. Further protection to the vial is afforded by the top parts of the vial supporting portions 27, which are relatively thick. It will be noted that each vial lies closely adjacent to a vertical surface of the web 15 that extends upward from the rib 32 to some distance above the vial and which further protects the vial. Thus each vial as a whole can be said to be seated in a relatively deep upwardly and sidewardly opening pocket, defined by its rib 32, its pads 22*a*, 23*a* or 22*b*, 23*b* and the web 15, and it is well protected by those pocket defining portions of the body although readily visible from above the body.

In the particular bending tool here illustrated, the body is formed with integral ridges 37 that define sighting lines contained in a plane parallel to the plane of symmetry, and each such line, when it is perpendicular to a surface that supports a tube being bent, designates the attainment of a predetermined bend angle. For a more complete disclosure of the nature and purpose of these ridges, reference may be made to U.S. Pat. No. 4,442,695 to W. E. Gardner. In the present case the ridges supplement the spirit levels in indicating bend angles. The ridges, or some of them, can signal the attainment of particular bend angles other than those for which the spirit levels are arranged, and provide some measure of reinforcement to the tool body. Of course, the ridges 37 are not essential on a tool body embodying the present invention, but they constitute a desirable feature obtainable at negligible cost.

From the foregoing description taken with the accompanying drawings it will be apparent that this invention provides a tube bending tool with spirit level bend angle indicating means which can be produced at substantially lower cost and with substantially less labor than has heretofore been needed in the manufacture of such tools; and it will also be apparent that the spirit level bend indicating means is well protected but is nevertheless readily visible from above the tool body.

What is claimed as the invention is:

1. A tool for bending conduit and the like, comprising a body having an upwardly projecting handle supporting portion, a conduit engaging hook at a front end of the body, and an elongated bottom shoe portion extending rearward from said hook and defining a downwardly opening groove which is convexly arcuate along its length and is from side to side symmetrical to a plane of symmetry that lies in the body, said tool further comprising an elongated spirit level vial on the body for indicating the attainment of a predetermined bend angle in conduit being bent by means of the tool, said tool being characterized by:

A. said vial being cylindrical and straight along its length;

B. said body being formed with a pair of spaced apart pads, each having thereon a flat surface which extends in a direction away from said plane of symmetry and towards one side of the body, said flat surfaces on said pads (1) being opposed to one another, (2) being spaced apart in the direction lengthwise of said shoe portion by a distance at least equal to the length of the vial, and (3) defining between them a space which opens unrestrictedly towards said one side of the body so that the vial is insertable between said flat surfaces by movement transverse to its length towards said plane of symmetry; and C. each said pad having a vial supporting portion projecting from its said flat surface partway towards the other pad and defining a recess that opens towards said side of the body and towards the other pad and wherein an end portion of the vial is received upon insertion of the vial into said space, said recess having a concavely arcuate surface to which said end portion of the vial is adhesively secured and which (1) is curved on a radius substantially equal to that of the vial and (2) embraces the vial around no more than half of its girth and at its side adjacent to said plane of symmetry, said vial supporting portions of said pads being spaced apart by a substantial distance to leave the medial portion of the vial open to view from above the body.

2. The tool of claim 1 wherein said body has a reinforcing web extending between said handle supporting portion and said shoe portion that has surfaces parallel to said plane of symmetry and at opposite sides thereof, and wherein said pads project towards said one side of the body from said reinforcing web, further characterized by:

(1) said vial supporting portions of the pads being located and arranged to dispose the vial at a distance below an upper edge of the web so that a portion of the web extends above the vial to protect the same and (2) said body having thereon a reinforcing rib which bridgingly connects said pads at their bottoms, underlies the vial along its length, and projects laterally from the web to a substantial distance beyond the vial to further protect the same.

3. A tool for bending conduit and the like, comprising a body having opposite sides, said body having a conduit engaging hook at a front end thereof, an elongated shoe portion extending rearward from said hook that is curved in a convex arc along its length and has a downwardly projecting flange along each of its opposite sides, and an upwardly projecting handle supporting portion, said tool further comprising an elongated spirit level vial fixed on the body for indicating the attainment of a predetermined bend angle in conduit being bent by means of the tool, said tool being characerized by:

A. said vial being cylindrical and straight along its length;

B. said body being formed with a pair of pads thereon, one for each end portion of the vial, which cooperate to support the vial in a predetermined position with its length parallel to that of said shoe portion, each said pad (1) projecting towards one side of the body and (2) being shaped to define a recess which opens unrestrictedly to said one side of the body and towards the other pad and in which an end portion of the vial is closely receivable upon movement of the vial transversely to its length from said one side of the body, said pads being spaced apart in a direction lengthwise of said shoe portion by a distance such as to leave a substantial length of the vial between its end portions open to view from above the body;

C. said recess in each pad being of such depth in the direction from side to side of the body that the pad overlies the vial across not substantially more than half its diameter, thus leaving one side of the vial, along its entire length, open to view from above the body.

4. The tool of claim 3, further characterized by: said recess in each pad being defined by (1) a substantially flat surface on the pad which faces towards the other pad and which is spaced from the flat surface on the other pad by a distance at least equal to the length of the vial, and (2) a concave substantially semicylindrical surface on the pad which extends axially from said flat surface through a minor part of the distance to the other pad and which embrances an end portion of the vial around no more than half of its girth and at its side remote from said one side of the body.

5. The tool of claim 4 further characterized by an adhesive bonding agent between each of said substantially cylindrical surfaces and the surface of the vial that is embraced by it, whereby the vial is secured in said recesses.

* * * * *